US010395584B2

(12) United States Patent
Nadershahi

(10) Patent No.: US 10,395,584 B2
(45) Date of Patent: Aug. 27, 2019

(54) INTENSITY SCALED DITHERING PULSE WIDTH MODULATION

(71) Applicant: Planar Systems, Inc., Beaverton, OR (US)

(72) Inventor: Shahnad Nadershahi, Hillsboro, OR (US)

(73) Assignee: Planar Systems, Inc., Beaverton, OR (US)

( * ) Notice: Subject to any disclaimer, the term of this patent is extended or adjusted under 35 U.S.C. 154(b) by 108 days.

(21) Appl. No.: 15/494,150

(22) Filed: Apr. 21, 2017

(65) Prior Publication Data

US 2018/0144676 A1 May 24, 2018

Related U.S. Application Data

(60) Provisional application No. 62/425,545, filed on Nov. 22, 2016.

(51) Int. Cl.
*G09G 3/32* (2016.01)
*H05B 37/02* (2006.01)
*G09G 3/20* (2006.01)

(52) U.S. Cl.
CPC ..... *G09G 3/2055* (2013.01); *G09G 3/2014* (2013.01); *G09G 3/2044* (2013.01);
(Continued)

(58) Field of Classification Search
CPC ..... H05B 41/36; H05B 37/02; H05B 33/00; H05B 33/08; H05B 33/0824;
(Continued)

(56) References Cited

U.S. PATENT DOCUMENTS 6,008,794 A * 12/1999 Ishii ..... G09G 5/02 345/572
6,985,164 B2 1/2006 Rogers et al.
(Continued)

FOREIGN PATENT DOCUMENTS

CN 102736565 A 10/2012
CN 203177049 U 9/2013
(Continued)

*Primary Examiner* — Chanh D Nguyen
*Assistant Examiner* — Nguyen H Truong
(74) *Attorney, Agent, or Firm* — Stoel Rives LLP

(57) ABSTRACT

A circuit for driving at least one light emitting diode (LED) of a display based on a greyscale vector. The circuit includes brightness scale detection circuitry to determine a brightness value based on the greyscale vector and refresh cycle selection circuitry to output an indication of a subset of refresh cycles, referred to as dithered refresh cycles. The circuit also includes pulse width determination circuitry to define a pulse width based on the greyscale vector. Pulse adjustment control circuitry, for each dithered refresh cycle, determines a dithered pulse width by adjusting the pulse width by a width adjustment amount, and outputs a dithered pulse width modulation signal including a series of pulses including a pulse having the pulse width determined by the pulse width determination circuitry non-dithered refresh cycles and a pulse having the dithered pulse width for the dithered refresh cycles.

19 Claims, 6 Drawing Sheets

(52) U.S. Cl.
CPC ..... *G09G 3/32* (2013.01); *G09G 2310/0272* (2013.01); *G09G 2310/08* (2013.01); *G09G 2320/0242* (2013.01); *G09G 2320/064* (2013.01); *G09G 2360/16* (2013.01)

(58) Field of Classification Search
CPC ..... H05B 33/086; H05B 33/089; H05B 33/0815; H03K 3/017; H03K 7/08; G09G 3/20; G09G 3/30; G09G 3/32; G09G 3/34; G09G 3/36; G09G 5/00; G09G 5/02; G09G 5/10; G02F 1/133; G02F 1/13357
See application file for complete search history.

(56) References Cited

U.S. PATENT DOCUMENTS

| | | | | |
|---|---|---|---|---|
| 7,663,650 | B2 | 2/2010 | Suzuki et al. | |
| 8,143,794 | B1 | 3/2012 | Li et al. | |
| 8,334,660 | B2 | 12/2012 | Li et al. | |
| 8,462,025 | B2 | 6/2013 | Li et al. | |
| 8,525,424 | B2 | 9/2013 | Li et al. | |
| 8,963,810 | B2 | 2/2015 | Li et al. | |
| 8,963,811 | B2 | 2/2015 | Li et al. | |
| 9,047,810 | B2 | 6/2015 | Li et al. | |
| 9,089,027 | B2 | 7/2015 | Li et al. | |
| 9,183,789 | B2 | 11/2015 | Takahashi et al. | |
| 9,485,827 | B2 | 11/2016 | Li et al. | |
| 9,671,609 | B2 | 6/2017 | Nadershahi et al. | |
| 2003/0016189 | A1* | 1/2003 | Abe | G09G 3/20 345/55 |
| 2003/0052904 | A1* | 3/2003 | Gu | G09G 3/2014 345/691 |
| 2007/0216638 | A1* | 9/2007 | Kojima | G09G 3/3413 345/102 |
| 2008/0116827 | A1 | 5/2008 | Williams | |
| 2008/0158268 | A1* | 7/2008 | Hui | G09G 3/2022 345/691 |
| 2010/0026722 | A1* | 2/2010 | Kondo | G09G 3/2007 345/660 |
| 2013/0293140 | A1 | 11/2013 | Bohm et al. | |
| 2014/0300284 | A1* | 10/2014 | Lee | H05B 33/086 315/186 |
| 2015/0123555 | A1 | 5/2015 | Li et al. | |
| 2016/0033111 | A1 | 2/2016 | Thraen | |
| 2016/0155892 | A1 | 6/2016 | Li et al. | |
| 2016/0353539 | A1 | 12/2016 | Li et al. | |

FOREIGN PATENT DOCUMENTS

| | | |
|---|---|---|
| CN | 203177050 U | 9/2013 |
| CN | 203178656 U | 9/2013 |

* cited by examiner

INTENSITY SCALED DITHERING PULSE WIDTH MODULATION

RELATED APPLICATION

This application claims benefit under 35 U.S.C. § 119(e) of U.S. Provisional Application No. 62/425,545, filed Nov. 22, 2016, titled INTENSITY SCALED DITHERING PULSE WIDTH MODULATION, which is hereby incorporated by reference in its entirety.

TECHNICAL FIELD

The present disclosure relates generally to electronic display systems, and in particular, to light emitting diode (LED) display systems that use pulse width modulation (PWM) dithering in an LED driver circuit to drive an LED array.

BACKGROUND

Some conventional LED drivers use PWM and related control techniques to deliver current to LEDs. The PWM technique is a common method to control gradient levels of frame content while rendering the frame content to control a grayscale in modern display electronic circuits. PWM is increasingly used in modern commercial LED driver integrated circuits to deliver pulsed and controlled mean current to the LEDs in most high pitch large format Direct View LED (DV-LED) displays.

An LED display panel generally refers to a device which comprises an array of LEDs that are arranged in one or more rows and columns. Alternatively, an LED display panel may include a plurality of sub-modules, each sub-module having one or more such LED arrays. LED panels may employ arrays of LEDs of a single color or different colors. When LEDs of the same color are used in certain display applications, each LED normally corresponds to a display unit or pixel. When LED panels employ LEDs of different colors for a full-color display, a display unit or pixel normally includes a cluster of three LEDs—typically a red LED, a green LED, and a blue LED. Such a cluster of three LEDs may be referred to as an RGB unit.

An LED driver circuit delivers power to the array of LEDs and controls the current delivered to the array of LEDs. The LED driver circuit may be a single channel driver or a multi-channel driver. Each channel of the driver circuit may deliver power to a plurality of LEDs and control the current delivered to the LEDs. When a group of LEDs is electrically coupled to the same channel, the group of LEDs are often referred to as a "scan line."

In general, LED driver circuits control the brightness of the LEDs by varying the current delivered to and flowed through the LEDs. In response to the delivered current, the LED emits light with a brightness in accordance with the characteristic specifications of the LED. A greater current delivered to the LED usually translates to a greater intensity of brightness. To effectively control the delivery of current, LED driver circuits may employ a constant current source in combination with the modulation (i.e., turning ON and OFF) of the constant current source, using, for example, PWM to achieve a desired average (mean) current over each scan cycle.

Dithering is a technique that aims to achieve a gradient using an insertion of a number of intermediate colors when abrupt color transitions are seen in content. Color artists use this technique to modify content where visible step transitions in a color gradient due to limited color resolution cause an artifact referred to as banding. Dithering has been used in early machine and rendering devices that were too primitive to display more than a few colors. The reason dithering is effective is because the human eye is imperfect and can distinguish the pixels with limited accuracy and resolution, so the human eye tends to mix the color of a specific pixel with the pixels' neighboring pixels. PWM dithering exploits these properties of the human eye to create an appearance of smoother color gradient, by selectively adding noise at abrupt color transitions.

There are a variety of known PWM based solutions and architectures deployed in the design of modern LED drivers and some of these solutions and architectures use dithering in conjunction with PWM. The present inventor has recognized that known PWM dithering solutions are not effective when the brightness of the content is too high or too low as PWM dithering adjustments are applied uniformly to all the frame content without consideration of brightness levels of the frame content.

SUMMARY

In accordance with the present disclosure, an intensity-scaled dithering (ISD) PWM system may provide a smoother gradient during brightness transitions. In one embodiment, circuit for driving at least one light emitting diode (LED) of a pixelated display based on a greyscale vector for a plurality of refresh cycles includes brightness scale detection circuitry configured to receive the greyscale vector and determine a brightness value based on the greyscale vector. The circuit also includes refresh cycle selection circuitry configured to output an indication of a subset of refresh cycles out of the plurality of refresh cycles, such that the subset of refresh cycles are dithered refresh cycles and a remainder of the plurality of refresh cycles are non-dithered refresh cycles. Pulse width determination circuitry of the circuit is configured to receive the greyscale vector and define a pulse width based on the greyscale vector.

Pulse adjustment control circuitry is configured to receive the pulse width, the brightness value, and the indication of the subset of refresh cycles. For each dithered refresh cycle, the pulse adjustment control circuitry determines a width adjustment amount based on the brightness value, and determines a dithered pulse width by adjusting the pulse width by the width adjustment amount. A dithered pulse width modulation signal including a series of pulses is outputted by the pulse adjustment control circuitry. The series of pulses include a pulse having the pulse width determined by the pulse width determination circuity for each refresh cycle of the non-dithered refresh cycles and a pulse having the dithered pulse width for each refresh cycle of the dithered refresh cycles. A current source is configured to receive the dithered pulse width modulation signal and to supply current to the at least one LED based on the dithered pulse width modulation signal.

Additional aspects and advantages will be apparent from the following detailed description of preferred embodiments, which proceeds with reference to the accompanying drawings.

DETAILED DESCRIPTION OF PREFERRED EMBODIMENTS

Embodiments of the disclosed technology employ a PWM technique to modify an image by applying dithering noise scaled by the intensity, or brightness, of the illumination of the frame content. That is, the amount of dithering noise applied is related to the intensity of the illumination of the frame content.

In a typical implementation of an LED display employing PWM architecture, a display screen is refreshed with the same frame content multiple times. These refresh cycles are critical to enhancing the viewing of content. In some products, the frame content is refreshed on the screen as many as 32 or 64 times in each frame period, which is typically $1/60^{th}$ of a second. Each refresh cycle corresponds to a plurality of scan lines, each scan line relating to a pixel including at least one LED. During each refresh segment, the at least one LED on each scan line is driven by an LED driver based on the frame content.

Figure 1:
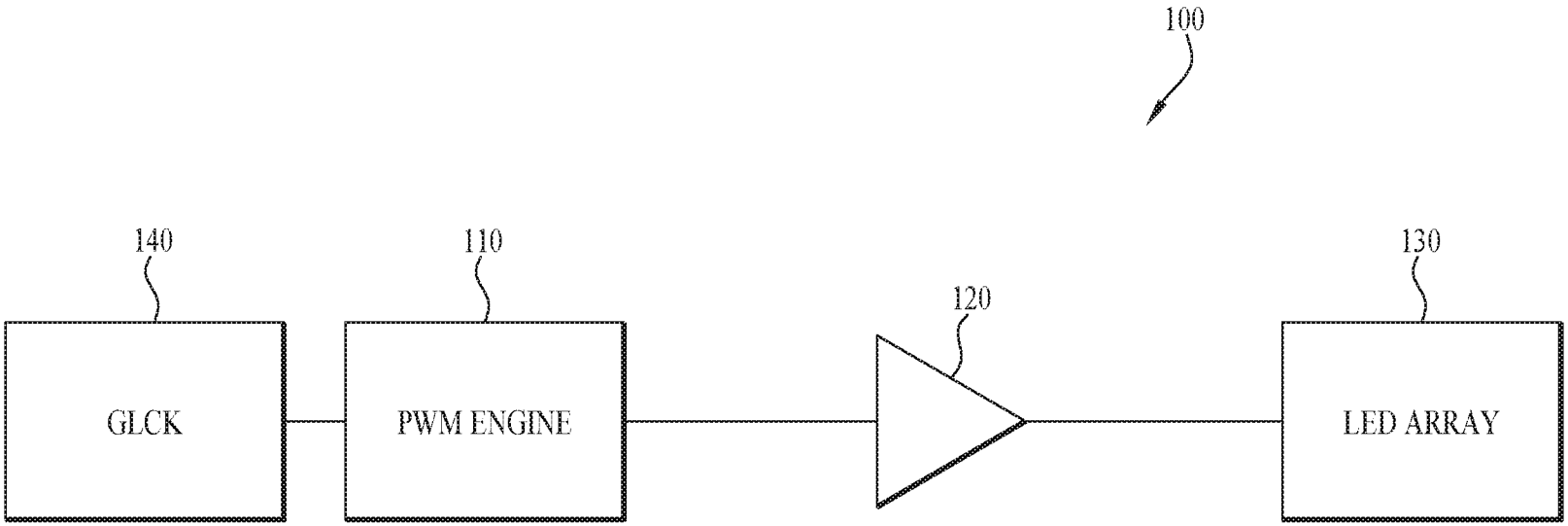
FIG. 1 illustrates an LED driver circuit according to an embodiment of the disclosed technology.

FIG. 1 illustrates a block diagram of an LED driver circuit 100 including a PWM engine 110 and a current source 120. The PWM engine 110 generates a PWM signal used to drive an LED array 130 through the current source 120. The PWM engine 110, as discussed below, generates a PWM signal that is sent to the current source 120, and the current source 120 outputs a current to the LED array 130 based on the received PWM signal. Other components may be included on the LED driver circuit 100, such as a clock GCLK 140 used by the PWM engine 110 to generate the PWM signal. The LED driver circuit 100 may include other features (not shown) required for the display device. The LED driver circuit 100 may be an integrated circuit, or may be a plurality of electrically connected circuits.

The PWM engine 110 may comprise any device or circuit now known or that may be developed in the future to generate a train of pulses of any desired shape. For example, the PWM engine 110 may comprise devices such as comparators, amplifiers, oscillators, counters, frequency generators, ramp circuits and generators, digital logic, analog circuits, application specific integrated circuits (ASIC), microprocessors, microcontrollers, digital signal processors (DSPs), state machines, digital logic, field programmable gate arrays (FPGAs), complex logic devices (CLDs), timer integrated circuits, digital to analog converters (DACs), analog to digital converters (ADCs), etc.

In modern conventional PWM display systems, display grayscale words for frame content are provided through an input, such as a high definition multimedia interface (HDMI), as 12 bits. Grayscale words define the intensity of a pixel for that frame content, and may apply to monochromatic pixels as well as colored pixels. The input is applied to a gamma conversion table, as is known in the art, to produce display specific and gamma converted grayscale vectors, referred to herein as a grayscale value. The conversion adds four additional bits to the original grayscale word that are designed to comply with the gamma conversion scheme standard, which results in a grayscale value that is 16 bits. As discussed in more detail below, the four least significant bits (LSBs) of the grayscale value are used by the disclosed technology to implement gradient smoothing. However, in some embodiments, more or less than four LSBs of the grayscale value may be used.

Figure 2:
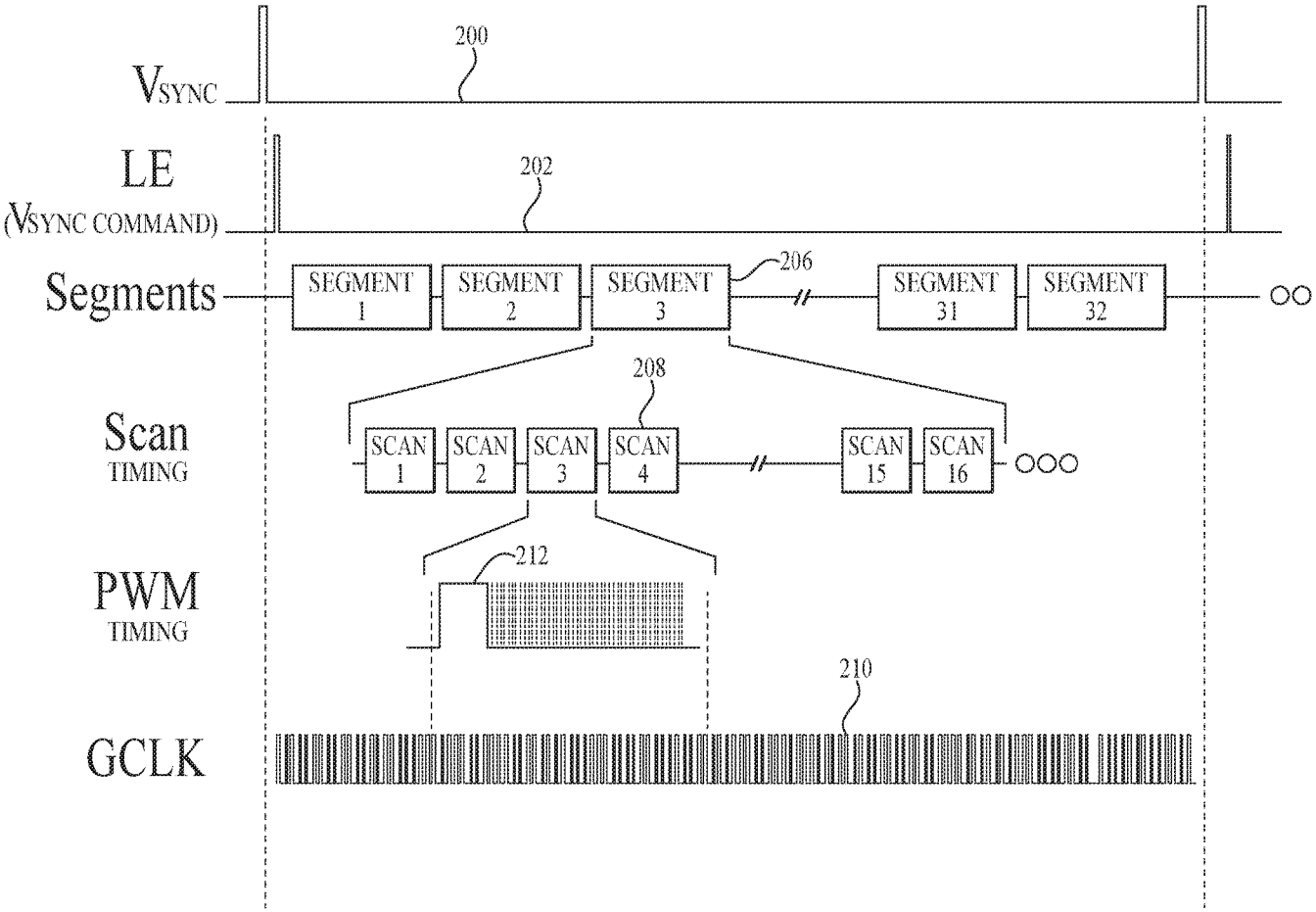
FIG. 2 illustrates a timing diagram for a single frame with a 60 Hz frame rate timing.

FIG. 2 illustrates a block timing diagram used by the LED driver circuit 100 for an architecture that implements 32 refresh cycles for displaying the frame content. Since each refresh cycle has sixteen scan lines in this example, corresponding to sixteen pixels, the LED driver circuit 100 will drive each scan line based on a received grayscale value for that pixel. That is, the LED driver circuit 100 will load 16 grayscale values, one for each of the sixteen scan lines. To simplify the discussion below, a single grayscale value and scan line may be discussed at times, but one of ordinary skill in the art will recognize that such will apply to each of the grayscale values and scan lines.

A vertical synchronization (Vsync) signal 200 indicates a new grayscale value input. After a pulse of a Vsync signal 200 is received, a high pulse of a latch enable (LE) signal 202 provides a read command to begin displaying the frame content related to the received grayscale value input. For a 120 Hz frame rate, each frame of content is displayed and refreshed for 8.33 ms. For a 60 Hz frame rate, each frame of content is displayed and refreshed for 16.67 ms. Between each Vsync signal, the clock GCLK signal 210 will have $2^{20}$ clock cycles for a 16-bit architecture. The frame rate determines the frequency of the clock GCLK signal 210.

The PWM engine 110 drives the LEDs 130 in 32 refresh cycles, referred to as segments 206, as illustrated in FIG. 2, and discussed in more detail below. As mentioned above, during each segment 206, each of the sixteen scan lines 208, is driven once based on its received grayscale value and the LEDs 130 on each scan line is refreshed once.

Each segment 206 includes multiple scan lines 208 that represent the number of pixels scanned with each LED driver output. For example, in FIG. 2, 16 pixels are scanned during each segment 206. That is, as mentioned above, 16 grayscale values are loaded into the LED driver circuit 100, and each of the 16 pixels are driven based on their respective grayscale value. Each scan line 208 in FIG. 2 represents one pixel, which, as mentioned above, may include a single LED or multiple LEDs. During each scan line 208, a current is applied to the LED(s) for that pixel based on a PWM signal 212 determined by the grayscale value, as discussed in further detail below. That is, a current is supplied to each of the LEDs during each segment 206 based on the PWM pulse width for that scan line 208. The higher the mean current over the segment 206, the brighter the LED will appear.

Each scan line 208 is divided into a number of clock cycles representing the display resolution of the system. For a system with a standard HDMI input of 12 bits, the corresponding scan period is divided into 4096 clock cycles and the width of the PWM pulse generated by the PWM engine 110 may be anywhere between 0-4096 clock cycles. The longer the width of the pulse, the higher the time-averaged amount of current applied to the LED over the segment 206.

In FIG. 2, the frame rate is 60 Hz, the display resolution is defined as 16-bits wide, the scan rate is 16 level scans, and the number of segments is 32 refresh cycles. As mentioned above, the clock frequency is determined by the frame rate.

That is, the total number of clock cycles are determined by multiplying the number of refresh cycles by the display resolution and by the number of scans. For the timing diagram of FIG. 2, the total number of clock cycles is 2,097,152 cycles. For a 60 Hz frame rate, the total number of clock cycles translates into clock frequencies that are higher than 126 MHz and a period that is less than 8 ns. Correspondingly, for a 120 Hz frame rate, the clock frequencies should be at least 125 MHz, and in such a system with conventional PWM architecture, this PWM pulse width varies from $0\text{-}2^{11}$ clock cycles.

Although FIG. 2 shows 32 segments 206 and 16 scan lines 208, various numbers of segments and scans lines may be used depending on the display requirements. For example, the timing diagram may have 16 segments and 16 scan lines, or the timing diagram may have 64 segments and 16 scan lines. The LEDs 130 of the display may be driven by a single LED driver or may include a plurality of LED drivers, each LED driver driving a portion of the LEDs 130.

As mentioned above, embodiments of the disclosure are based on the concept of dithering the brightness of pixels randomly or pseudo-randomly across transitions from high brightness to low brightness in the frame content to create a smoother gradient. The amount of dithering is based on the intensity, or brightness, of the frame content, while the segments 206 to perform the PWM dithering in are chosen randomly or pseudo-randomly. Embodiments of the disclosure use the segments 206 in conjunction with the randomization of PWM dithering to create the smoother gradient.

A grayscale value that is 16 bits of information may be divided into two fields. The grayscale value defines the intensity of a corresponding pixel for that frame content. Some of the bits of the grayscale value may be used to define the amount of noise, or dithering, and some bits may be used to define the strategy for random insertion of noise when the frame content is refreshed during the segments 206.

For example, some of the bits of the grayscale value correspond to the intensity, or brightness for a pixel of a scan line 208 within a segment 206, which corresponds to a pulse width of the pulse width modulation signal. Some of the pulse widths of the pulse width modulation signal during the segments 206 may be modified to apply dithering, based on the brightness, or intensity, of the frame content as well as the remainder of the bit of the grayscale value, as discussed in more detail below.

Figure 3:
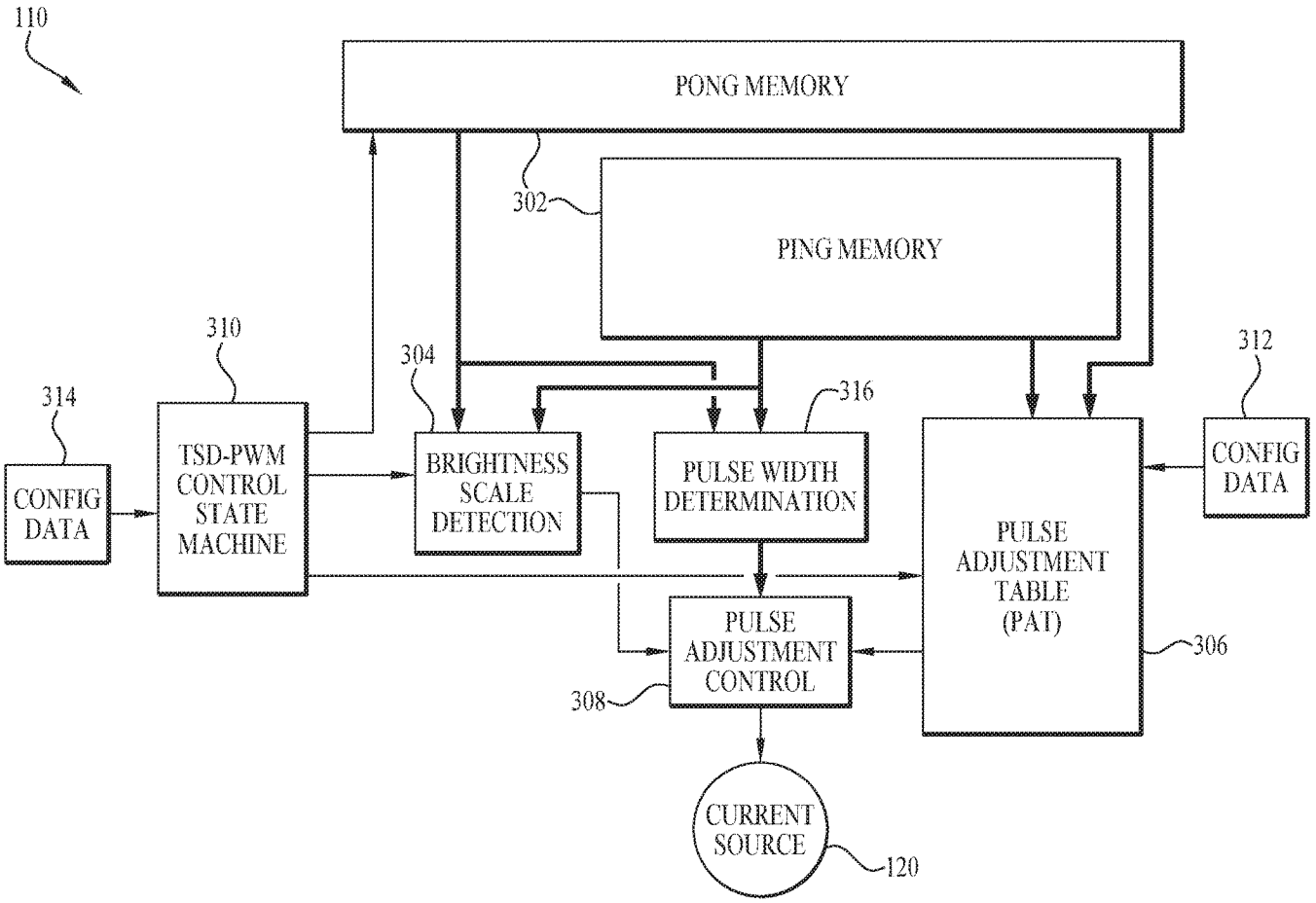
FIG. 3 illustrates a block diagram of a PWM modulation engine according to an embodiment of the disclosed technology.

FIG. 3 illustrates a block diagram of a PWM engine 110 of FIG. 1 according to some embodiments of the disclosure. The PWM engine 110 will be described with reference to the timing diagram of FIG. 2. The PWM engine 110 may include a memory 302, such as a ping-pong memory, as shown in FIG. 2, so that grayscale values for the next frame content may be written into pong memory 302 while the current grayscale values are being read from the ping memory 302 for display, or vice versa.

The PWM engine 110 also includes a brightness scale detection block 304 that decodes, for each pixel, the grayscale value to determine and categorize the intensity of the frame content into m number of categories. The number of categories m is defined by the implementation complexity of the LED driver circuit. For more simplistic circuits, m may be a lower number and for more complex circuits, m may be a greater number. The brightness scale detection block 304 outputs a brightness value to the pulse adjustment control 308. The brightness value is based on a number of clock cycles the grayscale value indicates the LED(s) in the pixel is on. For example, m may be 5, and the brightness scale detection block 304 may be categorized based on the following thresholds: 0-32 clock cycles (category 1), 32-512 clock cycles (category 2), 512-1024 clock cycles (category 3), 1024-1536 clock cycles (category 4), and 1536-2048 clock cycles (category 5). The higher the amount of clock cycles indicated in the grayscale value, the brighter the frame content. That is, the grayscale value may indicate that the LED(s) in the pixel should be on for 618 clock cycles, and so the brightness value would fall into the third category. Although five categories are set for the brightness scale detection block 304 in this example, any number of categories may be set as required by different display devices and desired complexity, as mentioned above.

The PWM engine 110 also includes a pulse adjustment table block 306 that receives the grayscale value and outputs a subset of segments 206 of the segments 206 that use the grayscale value, which may be referred to as dithered segments below. The non-selected segments 206 are referred to as non-dithered segments. In some embodiments, the pulse adjustment table block 306 may receive the grayscale value, and using the least significant bits of the grayscale value, determine the subset of segments 206 based on a look-up table. For example, the least significant bits of the grayscale value may address a specific entry in the table that identifies the subset of segments 206. Such a look-up table may be configured by receiving configuration data 312 to configure the data of the look-up table. This allows the look-up table to be configured based on a specific display, for example. However, in some embodiments, the pulse adjustment table block 306 may randomly generate a subset of segments 206 each time a grayscale value is received using a random number generator, rather than using a look-up table.

Pulse width determination circuitry 316 is also included in the PWM engine 110 and receives the clock GCLK signal 210 from the clock 140 as well as the grayscale value from the memory 302. The pulse width determination circuitry 316 then generates a pulse width based on the grayscale value and the clock GLCK signal 210. A width of the pulse corresponds to the number of GCLK cycles that the LED is on within a single segment 206 for its corresponding scan. That is, the pulse width determination circuitry 316 receives the grayscale value and based on that value, counts out a pulse width using the clock signal GLCK 210 generated by the clock 140. In some embodiments, the pulse width determination circuitry 316 is included in the pulse adjustment control block 308, discussed below.

A pulse adjustment control block 308 of the PWM engine 110 receives the pulse width from the pulse width determination circuitry 316 and, outputs a series of pulses, each pulse corresponding to a segment 206. The pulse adjustment control block 308 also receives the brightness value from the brightness scale detection block 304, as well as the subset of segments 206 from the pulse adjustment table block 306. Within the series of pulses, for any segments 206 within the subset of segments 206 identified by the pulse adjustment table block, that is, dithered segments, the pulse adjustment control block 308 outputs a pulse having the received pulse width from the pulse width determination circuitry 316 adjusted based on the brightness value. For all other segments 206, i.e., non-dithered segments, the pulse adjustment table block 306 outputs a pulse with the received pulse width from the pulse width determination circuitry 316.

An ISD-PWM control state machine 310 in the PWM engine 110 performs the sequence control and order of operations for the memory 302, the brightness scale detection block 304, the pulse adjustment table block 306, and the pulse adjustment control block 308.

In operation, the ISD-PIWM control state machine 310 receives configuration data 314 to determine the required operation orders and timings for a specific display, which may be loaded by a user or stored in a memory, and sends control signals to each of the various components, including memory 302, brightness scale detection block 304, pulse adjustment table 306, and pulse adjustment control 308 to perform various calculations and determinations, as discussed above.

Multiple processes may be used to determine the adjustment amount based on the brightness value by the pulse adjustment control block 308. The adjustment amount corresponds to a pulse of the clock signal GLCK 210.

In one method, which may be referred to as a direct method, the adjustment amount is directly linked to the categories and thresholds that are detected in the brightness scale detection block 304 for each dithered segment. As such, each pulse corresponding to each dithered segment has the same adjusted width. For example, in some embodiments, if the brightness value is category 1, the pulse adjustment block 308 does not adjust the pulse width, and as such, the adjustment amount is 0. If the brightness value is category 2, the adjustment amount is set at 1 clock cycle. If brightness value is category 3, the adjustment amount is set at 2 clock cycles. If the brightness value is category 4, the adjustment amount is set at 3 clock cycles. If the brightness value is category 5, the adjustment amount is set as 4 clock cycles. In this example, the adjustment amount is the number of clock cycles the width, determined by the pulse width determination circuitry 316, is adjusted. However, the category and brightness values, as well as adjustment values may be adjusted to fit various display requirements and the above is provided just as an exemplary example.

The direct method produces and mimics noise characteristics closely to facilitate visible gradient of the content, especially when the content abruptly transitions in brightness levels, while minimizing the complexity of the implementation of the ISD PWM.

In another method, which may be referred to as an alternate cascade method, a more complex implementation of the ISD-PWM may be applied to even more closely mimic noise characteristics than the direct method. In this implementation, the adjustment amount is reduced in consecutive segments 206.

Again, the adjustment amount in this method is selected based on the brightness value, similar to the direct method discussed above, and also based on which segment 206 the PWM dithering is being performed. That is, the segments 206 may also be placed into categories, similar to the grayscale value, based on the following thresholds: segments 1-8 (category 1), segments 9-16 (category 2), segments 17-24 (category 3), segments 25-32 (category 4). These categories, however, are provided merely as an example, and the segments 206 may be placed in any number of categories suitable for the display characteristics. For example, only a single threshold may be chosen, resulting in two categories of segments 206.

Figure 4:
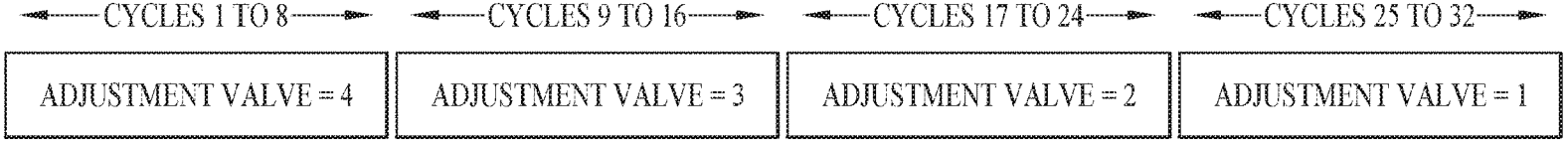
FIG. 4 illustrates an example of an alternate cascade method according to one embodiment of the disclosed technology.

Initially, the adjustment amount is selected similar to the direct method above. For example, if the brightness value is category 5, the adjustment amount is 4 clock cycles. If a segment 206 of the subset of segments 206 falls within category 1, the originally determined adjustment value is used. If a segment 206 of the subset of segments 206 falls within the second category, then the adjustment value is reduced by 1 clock cycle. If a segment 206 of the subset of segments 206 falls within the third category, then the adjustment value is reduced by 2 clock cycles. If a segment 206 of the subset of segments 206 falls within the fourth category, then the adjustment value is reduced by 3 clock cycles. This is illustrated in FIG. 4.

Figure 5:
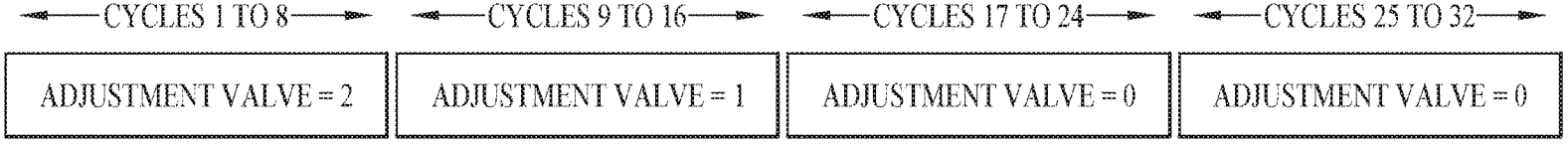
FIG. 5 illustrates another example of the alternate cascade method according to another embodiment of the disclosed technology.

Accordingly, if an initial adjustment value is less than 4 clock cycles, then some of the segments 206 of the subset of segments may not perform PWM dithering. This is illustrated, for example, in FIG. 5. In FIG. 5, the brightness value falls within the third category, so the adjustment value is 2 clock cycles. If any segments 206 of the subset of segments 206 falls within category 1 of the segments 206, then the adjustment value is 2 clock cycles. If any segments 206 of the subset of segments 206 falls within category 2 of the segments 206, then the adjustment value is 1 clock cycle. If any segments 206 of the subset of segments 206 falls within categories 3 and 4 of the segments 206, then the adjustment value is 0 and pulse widths for these segments 206 are not adjusted.

Accordingly, in operation, the LED driver 100 receives grayscale values for frame content that is to be displayed and refreshed over a plurality of segments 206. As mentioned above, each of the gray scale values defines the intensity of a pixel of each of the scan lines 208, respectively. Using a single scan line 208 as an example, the ISD-PWM control state machine 310 causes the brightness scale detection block 304 to load the grayscale value. The brightness scale detection block 304 determines the brightness value of that pixel based on the grayscale value. The ISD-PWM control state machine 310 causes the pulse width determination circuitry 316 to also receive the grayscale value from the memory 302. When the pulse width determination circuitry 316 receives the grayscale value, the pulse width determination circuitry 316 defines a pulse width corresponding to the brightness of the pixel. The ISD-PWM control state machine 310 also causes the pulse adjustment table block 306 to receive the grayscale value and output a subset of segments 206. The pulse adjustment control 308 receives the brightness value, the pulse width, and the subset of segments 206 and outputs a series of pulses, as discussed above.

As will be understood by one of ordinary skill in the art, the LED driver 100 is able to perform parallel operations for each of the scan lines, such that the above discussed process is performed for each received grayscale value corresponding to each scan line 208 (i.e., each pixel). As such, different scan lines 208 in different segments 206 receive an adjusted pulse width, resulting in random PWM dithering of the frame content across transitions from high brightness and low brightness. For example, in a fifth segment 206, the third, seventh, and eighth scans 208 may have adjusted pulse widths, while scans one, two, four, five, and six receive the pulse width from the respective gray scale value.

Although a grayscale value for each pixel is discussed above, in some embodiments, an average grayscale value for all of the pixels may be used to perform the PWM dithering. That is, the brightness scale detection block 304 and pulse adjustment table block 306 may receive the average grayscale value to determine the adjustment value and which segments 206 to perform PWM dithering. In other embodiments, only the brightness scale detection block 304 receives the average grayscale value, while the pulse adjustment table block receives the respective grayscale value for the respective scan line 208. As such, the grayscale value discussed within this disclosure is not limited to a grayscale value of a single pixel, but may include an average grayscale value.

Further, a brightness scale detection block 304, pulse width determination circuitry 316, pulse adjustment table 306, and pulse adjustment control 308 may be provided for each scan line 208. Each of the brightness scale detection blocks 304, pulse width determination circuitries 316, pulse adjustment tables 306, and pulse adjustment controls 308 may perform parallel operations for each scan line 208. That is, each of the brightness scale detection block 304, pulse width determination circuitry 316, pulse adjustment table 306, and pulse adjustment control 308 may receive a grayscale value, each grayscale value corresponding to a scan line 208.

Figure 6:
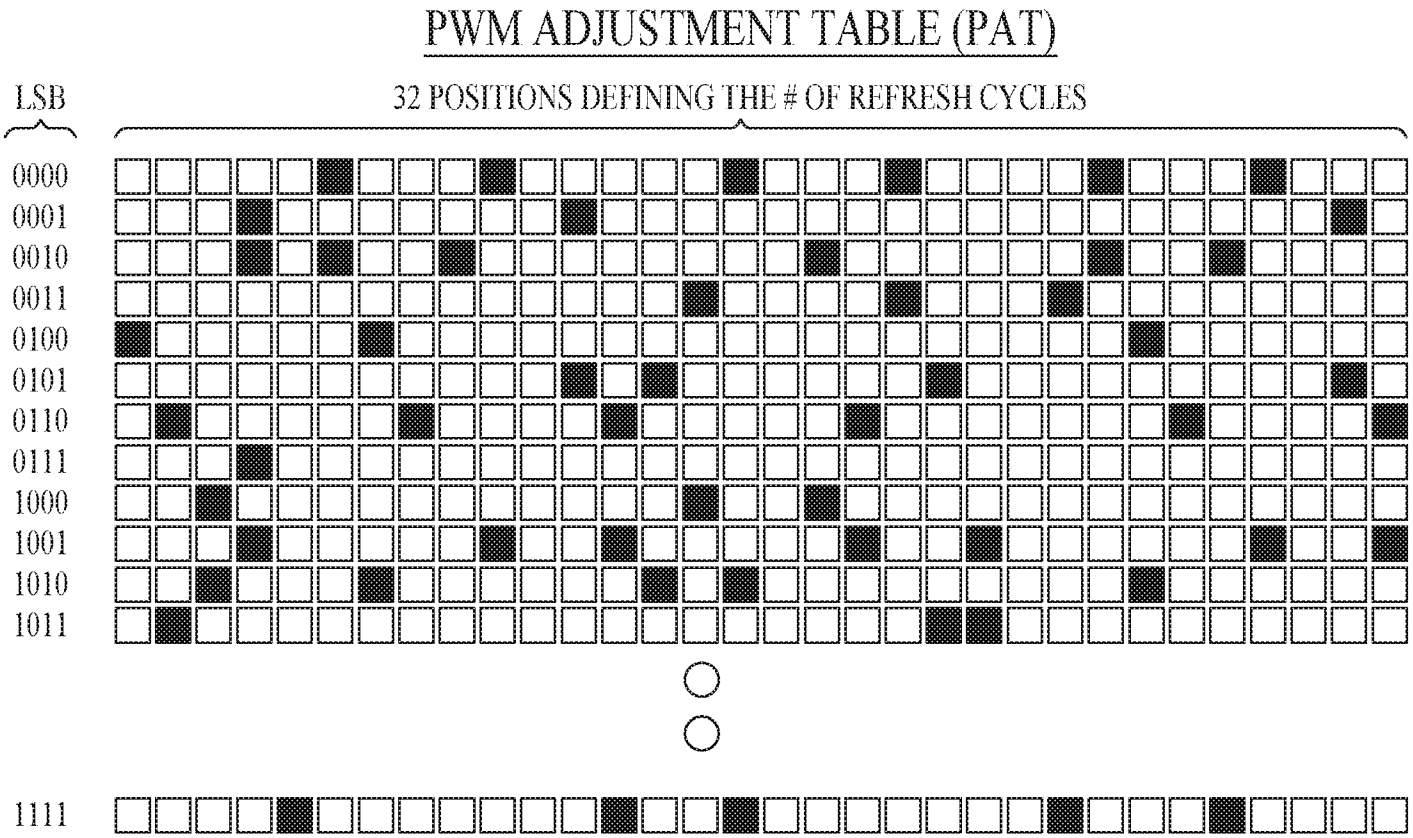
FIG. 6 illustrates a pulse adjustment table according to some embodiments of the disclosed technology.

FIG. 6 illustrates a look-up table that may be used by the pulse adjustment table block 306, according to some embodiments. As mentioned above, the least significant bits of the grayscale value are used as an address vector to determine which entry in the pulse adjustment table 306 to follow to determine which segments 206 will have PWM dithering. The look-up table includes 16 rows, corresponding to the four LSBs of the grayscale value. For example, in FIG. 6, the rows correspond to 0000 to 1111. Each row has 32 columns defining the 32 segments 206 for the timing diagram discussed above. However, as mentioned above, various numbers of segments 32 may be used to refresh the content, and the columns and rows correspond to the requirements of a specific display. For example, in some embodiments, each row may have 64 columns, defining 64 segments 206. In other embodiments, more or less rows may be provided, based on the number of LSBs that are used for the grayscale value.

A white box in each row designates a segment 206 in which the pulse width defined by the pulse width determination circuitry 316 is used. A black box in each row designates a segment 206 in which the pulse width defined by the pulse width determination circuitry 316 is adjusted by the pulse adjustment control block 308.

For example, as seen in the look-up table of FIG. 6, if the LSBs of the grayscale value are 0010, PWM dithering is performed on segments 4, 6, 9, 18, 25, and 28. That is, the pulse adjustment control block 308 adjusts the pulse width of those segments 206 for the respective scan line 208 based on the brightness value. As another example, if the LSBs of the grayscale value are 1011, PWM dithering is performed on segments 2, 21, and 22.

The look-up table may be created using randomization. The look-up table may be programmable such that the look-up table may be modified to fit various needs of different display devices.

Figure 7:
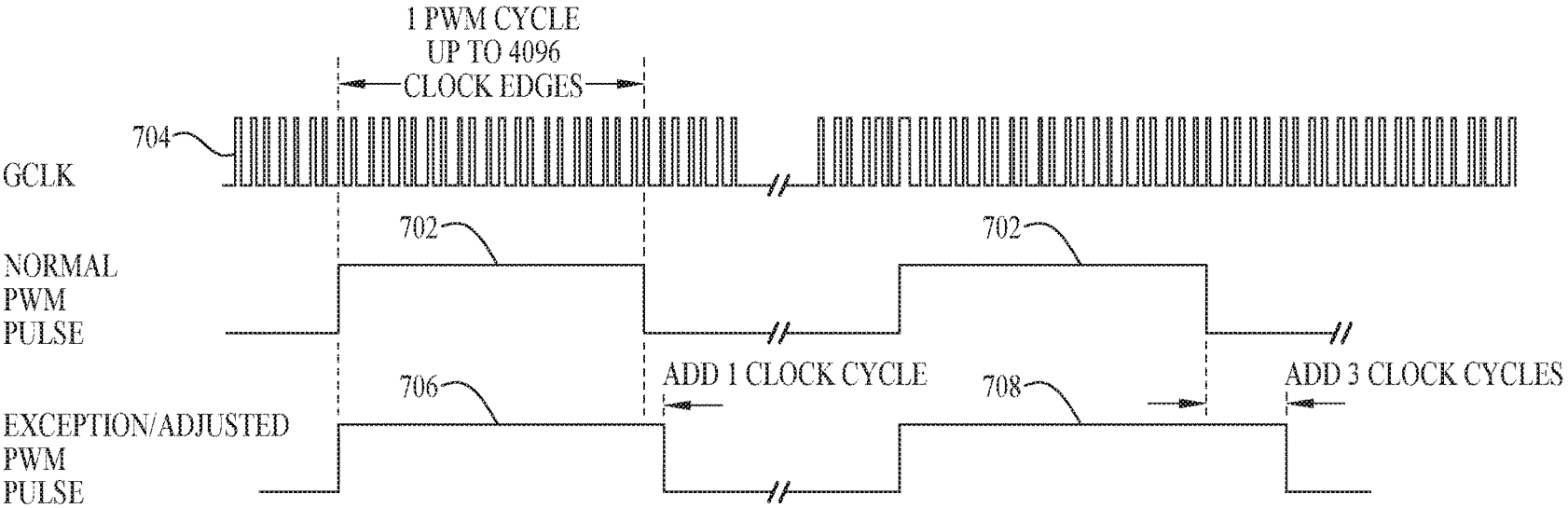
FIG. 7 illustrates various PWM signals using differing techniques.

FIG. 7 illustrates segments 206 with PWM dithering, according to embodiments of the disclosure, and segments 206 without PWM dithering. As seen in FIG. 7, pulse 702 illustrates a pulse width determined by pulse width determination circuitry 316 based on a grayscale value. The pulse width can be up to 4096 clock cycles. The GCLK signal 704 illustrates a clock signal with a variety of clock cycles. For segments 206 with PWM dithering performed according to the present disclosure, a pulse width is adjusted by a variable value, determined by the grayscale value. In pulse 706, the pulse width is adjusted by adding a clock cycle to the end of the pulse width, thereby lengthening the width for that scan line 208 in the segment 206. Pulse 708 is lengthened by 3 clock cycles, compared to a pulse 702 having a pulse width determined by pulse width determination circuitry 316. That is, pulse 702 is not dithered.

However, the pulse width may be adjusted by subtracting the adjustment value from the beginning of the pulse width or removing the adjustment value from the end of the pulse width. The adjustment value, however, in each embodiment, is determined based on the brightness value, as discussed above.

Many modifications and other embodiments of the disclosure will come to the mind of one skilled in the art having the benefit of the teaching presented in the forgoing descriptions and the associated drawings. Elements in the LED array can be single color LEDs or RGB units or any other forms of LEDs available. The LED driver 100 can be scaled up or scaled down to drive LED arrays of various sizes. Multiple LED drivers 100 may be employed to drive a plurality of LED arrays in a LED display system. The components in the driver can either be integrated on a single chip or on more than one chip or on a printed circuit board. Such variations are within the scope of this disclosure.

The described features, operations, or characteristics may be arranged and designed in a wide variety of different configurations and/or combined in any suitable manner in one or more embodiments. Thus, the detailed description of the embodiments of the systems and methods is not intended to limit the scope of the disclosure, as claimed, but is merely representative of possible embodiments of the disclosure. In addition, it will also be readily understood that the order of the steps or actions of the methods described in connection with the embodiments disclosed may be changed as would be apparent to those skilled in the art. Thus, any order in the drawings or Detailed Description is for illustrative purposes only and is not meant to imply a required order, unless specified to require an order.

Embodiments may include various operations, blocks, and circuitry, which may be embodied in machine-executable instructions to be executed by a general-purpose or special-purpose computer (or other electronic device). Alternatively, the operations, blocks, and circuitry may be performed by hardware components that include specific logic for performing the steps, or by a combination of hardware, software, and/or firmware.

For example, the hardware may comprise devices such as comparators, amplifiers, oscillators, counters, frequency generators, ramp circuits and generators, digital logic, analog circuits, application specific integrated circuits (ASIC), microprocessors, microcontrollers, digital signal processors (DSPs), state machines, digital logic, field programmable gate arrays (FPGAs), complex logic devices (CLDs), timer integrated circuits, digital to analog converters (DACs), analog to digital converters (ADCs), etc.

Embodiments including various operations, blocks, and circuitry may also be provided as a computer program product including a computer-readable storage medium having stored instructions thereon that may be used to program a computer (or other electronic device) to perform processes described herein. The computer-readable storage medium may include, but is not limited to: hard drives, floppy diskettes, optical disks, CD-ROMs, DVD-ROMs, ROMs, RAMs, EPROMs, EEPROMs, magnetic or optical cards, solid-state memory devices, or other types of medium/machine-readable medium suitable for storing electronic instructions.

As used herein, a block may include any type of computer instruction or computer executable code located within a memory device and/or computer-readable storage medium. A block may, for instance, comprise one or more physical or logical blocks of computer instructions, which may be organized as a routine, program, object, component, data structure, etc., that performs one or more tasks or implements particular abstract data types.

In certain embodiments, a particular software module may comprise disparate instructions stored in different locations of a memory device, which together implement the described functionality of the module. Indeed, a module may comprise a single instruction or many instructions, and may be distributed over several different code segments, among different programs, and across several memory devices. Some embodiments may be practiced in a distributed computing environment where tasks are performed by a remote processing device linked through a communications network. In a distributed computing environment, software modules may be located in local and/or remote memory storage devices. In addition, data being tied or rendered together in a database record may be resident in the same memory device, or across several memory devices, and may be linked together in fields of a record in a database across a network.

It will be obvious to those having skill in the art that many changes may be made to the details of the above-described embodiments without departing from the underlying principles of the invention. The scope of the present invention should, therefore, be determined only by the following claims.

The invention claimed is:

1. A circuit for driving at least one light emitting diode (LED) of a pixelated display based on a greyscale vector for a plurality of refresh cycles, comprising:

brightness scale detection circuitry configured to receive the greyscale vector and determine a brightness value based on the greyscale vector;

refresh cycle selection circuitry configured to output an indication of a subset of refresh cycles out of the plurality of refresh cycles, such that the subset of refresh cycles are dithered refresh cycles and a remainder of the plurality of refresh cycles are non-dithered refresh cycles;

pulse width determination circuitry configured to receive the greyscale vector and define a pulse width based on the greyscale vector;

pulse adjustment control circuitry configured to:

receive the pulse width, the brightness value, and the indication of the subset of refresh cycles, for each dithered refresh cycle, determine a width adjustment amount based on the brightness value, wherein:

when the brightness value is below a predetermined brightness threshold and a refresh cycle of the subset of refresh cycles is below a predetermined subset threshold, the width adjustment amount is a first value, and when the brightness value is below the predetermined brightness threshold, and a refresh cycle of the subset of refresh cycles is above the predetermined subset threshold, the width adjustment amount is a second value, different from the first value, for each dithered refresh cycle, determine a dithered pulse width by adjusting the pulse width by the width adjustment amount, and output a dithered pulse width modulation signal including a series of pulses, the series of pulses including a pulse having the pulse width determined by the pulse width determination circuity for each refresh cycle of the non-dithered refresh cycles and a pulse having the dithered pulse width for each refresh cycle of the dithered refresh cycles; and a current source configured to receive the dithered pulse width modulation signal and to supply current to the at least one LED based on the dithered pulse width modulation signal.

2. The circuit of claim 1, wherein the width adjustment amount is equal to a number of clock cycles of a clock signal.

3. The circuit of claim 2, wherein the width adjustment amount is between 1 and 4 clock cycles.

4. The circuit of claim 1, wherein when the brightness value is above the predetermined brightness threshold, the width adjustment amount is a third value different from the first and second values.

5. The circuit of claim 4, wherein the predetermined brightness threshold is a first predetermined brightness threshold, and when the brightness value is above a second predetermined brightness threshold that is different from the first predetermined brightness threshold, the width adjustment amount is a fourth value different from the first, second, and third values.

6. The circuit of claim 1, wherein when the brightness value is below a minimum threshold, the dithered pulse width equals the pulse width.

7. The circuit of claim 1, wherein the brightness value is determined based on a set of most significant bits of the greyscale vector.

8. The circuit of claim 7, wherein the greyscale vector is sixteen bits and the set of most significant bits are the first twelve of the sixteen bits.

9. The circuit of claim 1, wherein the refresh cycle selection circuitry outputs the indication based on the greyscale vector.

10. The circuit of claim 9, wherein indication of the subset of refresh cycles are based on a set of least significant bits of the greyscale vector.

11. The circuit of claim 10, wherein the greyscale vector is sixteen bits and the set of least significant bits is the last four of the sixteen bits.

12. The circuit of claim 9, wherein the refresh cycle selection circuity is further configured to indicate the subset of refresh cycles based on an entry of a look-up table that is addressed by at least a portion of the greyscale vector.

13. A method for driving a light emitting diode (LED) of a pixelated display based on a greyscale vector for a plurality of refresh cycles, the method comprising:

determining a brightness value based on the greyscale vector;

indicating a subset of refresh cycles from the plurality of refresh cycles, such that the subset of refresh cycles are dithered refresh cycles and a remainder of the plurality of refresh cycles are non-dithered refresh cycles;

determining a pulse width based on the greyscale vector;

for each refresh cycle of the dithered refresh cycles, determining a width adjustment amount based on the brightness value, wherein:

when the brightness value is below a predetermined brightness threshold and a refresh cycle of the subset of refresh cycles is below a predetermined subset threshold, the width adjustment amount is a first value, and when the brightness value is below the predetermined brightness threshold, and a refresh cycle of the subset of refresh cycles is above the predetermined subset threshold, the width adjustment amount is a second value, different from the first value;

for each refresh cycle of the dithered refresh cycles, determine a dithered pulse width by adjusting the pulse width by the width adjustment amount; and outputting to a current source a dithered pulse width modulation signal including a series of pulses, the series of pulses including a pulse having the pulse width determined by the pulse width determination circuity for each refresh cycle of the non-dithered refresh cycles and a pulse having the dithered pulse width for each refresh cycle of the dithered refresh cycles.

14. The method of claim 13, wherein the width adjustment amount is equal to a number of clock cycles of a clock signal.

15. The method of claim 14, wherein the width adjustment amount is between 1 and 4 clock cycles.

16. The method of claim 13, wherein when the brightness value is above the predetermined brightness threshold, the width adjustment amount is a third value different from the first and second values.

17. The method of claim 16, wherein the predetermined brightness threshold is a first predetermined brightness threshold, and when the brightness value is above a second predetermined brightness threshold that is different from the first predetermined brightness threshold, the width adjustment amount is a fourth value different from the first, second, and third values.

18. The method of claim 13, wherein when the brightness value is below a minimum threshold, the dithered pulse width equals the pulse width.

19. The method of claim 13, wherein indicating the subset of refresh cycles includes selecting an entry of a look-up table addressed by at least a portion of the greyscale value to indicate the subset of refresh cycles.

* * * * *